United States Patent [19]

Martinez et al.

[11] Patent Number: 4,917,994

[45] Date of Patent: Apr. 17, 1990

[54] COLOR PHOTOGRAPHIC REFLECTION PRINT MATERIAL WITH IMPROVED KEEPING PROPERTIES

[75] Inventors: Alberto M. Martinez, Rochester; Ronald G. Olsen, Fairport; Gary W. Visconte, Rochester, all of N.Y.

[73] Assignee: Eastman Kodak Company, Rochester, N.Y.

[21] Appl. No.: 162,915

[22] Filed: Mar. 1, 1988

[51] Int. Cl.[4] ..... G03C 7/26; G03C 1/30

[52] U.S. Cl. ..... 430/543; 430/372; 430/463; 430/523; 430/621; 430/623; 430/642; 430/935

[58] Field of Search ..... 430/372, 523, 961, 935, 430/642, 551, 463, 607, 623, 621, 543

[56] References Cited

U.S. PATENT DOCUMENTS

| | | | |
|---|---|---|---|
| 4,266,016 | 5/1981 | Date et al. | 430/527 |
| 4,358,534 | 11/1982 | Sasaki et al. | 430/551 |
| 4,377,634 | 3/1983 | Mifune et al. | 430/440 |
| 4,478,929 | 10/1984 | Jones et al. | 430/567 |
| 4,673,632 | 6/1987 | Okamura et al. | 430/510 |
| 4,764,453 | 8/1988 | Koboshi et al. | 430/351 |
| 4,767,698 | 8/1988 | Bergthaller et al. | 430/562 |

FOREIGN PATENT DOCUMENTS

| | | | |
|---|---|---|---|
| 0315109 | 5/1989 | European Pat. Off. . | |
| 1228437 | 11/1986 | Japan | 430/264 |

*Primary Examiner*—Paul R. Michl
*Assistant Examiner*—Lee C. Wright
*Attorney, Agent, or Firm*—Joshua G. Levitt

[57] ABSTRACT

Color photographic print materials are described in which the surface pH is between about 4.0 and 5.3. The photographic elements have improved keeping properties under adverse conditions of storage.

6 Claims, No Drawings

COLOR PHOTOGRAPHIC REFLECTION PRINT MATERIAL WITH IMPROVED KEEPING PROPERTIES

This invention relates to color photography. In a particular aspect it relates to color photographic materials intended to provide reflection prints.

Such materials are well known in the art. They generally comprise a reflective support bearing one or more silver halide emulsion layers and, optionally, subbing layers, interlayers, and overcoat layers which provide desired physical and/or sensitometric properties to the photographic material.

Photographic materials are known to exhibit changes in their sensitometric properties on storage. Exposure to conditions of high heat and high humidity can cause deterioration in the material which will be evidenced as an increase in minimum density (referred to as fog) after it is processed to provide a viewable image. Many compounds have been suggested for incorporation in photographic materials to protect these materials against deterioration on storage. While they generally are effective for their intended purpose there remains a need for additional or alternative means for reducing deterioration of photographic materials.

Heretofore color photographic reflection print materials have had a surface pH of 5.6 or greater.

We have found that if the pH of a photographic element is between about 4.0 and 5.3, there is a significant improvement in keeping properties when compared with materials coated at a higher pH.

Thus, in accordance with this invention, there is provided a color photographic print material comprising a support, one or more silver halide emulsion layers and optionally subbing layers, interlayers, and overcoat layers, wherein the element has a surface pH of between 4.0 and 5.3.

pH is measured at the surface of the photographic element with a surface pH electrode. Details of an appropriate technique are shown in Example 1, infra.

Surface pH is representative of the overall pH of the element. The pH of an individual layer can be the same as the surface pH, or it can vary from that value.

The pH of the element can be adjusted by adjusting the pH of one or more layers, prior to coating, to a value that will provide the desired surface pH to the element. Preferably it is the pH of the light sensitive emulsion layers that is adjusted. pH can be adjusted with any suitable acidic solution. The anion of the acid should be innocuous. A preferred acid is nitric acid.

The present invention is particularly effective when employed with elements which are hardened with an active hardener, such as carbamoyl pyridinium hardeners and bisformadinium hardeners.

Active hardeners are described in detail in U.S. Pat. Nos. 3,880,665; 4,055,427; 4,063,952; UK Patents 1,487,283; EP Application 0,162,308 published Nov. 27, 1985 and U.S. Application Ser. No. 022,192 filed Mar. 5, 1987.

The silver halide emulsions employed in the present invention preferably comprise silver chloride grains which are at least 80 mole percent silver chloride and less than 5 mole percent silver iodide, based on total silver halide. In a preferred form the silver halide grains consist essentially of silver chloride. Silver bromide can be present in concentrations of up to 20 mole percent, preferably up to 5 mole percent, based on total silver halide. Silver iodide can be present in concentrations of less than 5 mole percent, preferably less than 2 mole percent, based on total silver halide.

The silver halide emulsions comprise vehicles conventional in the art. Preferred vehicles are hydrophilic colloids which can be employed alone or in combination with hydrophobic materials. Preferred hydrophilic colloids are gelatin, e.g., alkali-treated gelatin or acid-treated gelatin, and gelatin derivatives such as acetylated gelatin, and phthalated gelatin.

The silver halide emulsions can be chemically and spectrally sensitized as is common in the art. The emulsions, or other layers of the material, can contain stabilizers, antifoggants, and other components intended to prolong the useful life of the material prior to exposure or of the photographic image obtained after development.

The material will commonly contain one or more dye-forming couplers which will provide the final viewable image. However, other means of forming a viewable image can be employed.

The material will have a reflective support which is typically a paper support coated with a polyolefin and a white pigment. Alternatively the support can be a reflective polymeric support.

The material will typically contain additional layers, such as subbing layers to improve adhesion to the support, and interlayers and overcoat layers to separate and protect the sensitive layers and to carrying stabilizers, filter dyes and the like.

Further details of the components of photographic reflection print materials, the way they are prepared and how they are processes to obtain a viewable image are provided in *Research Disclosure,* Nov. 1979, Item No. 18716, published by Kenneth Mason Publications, Ltd., The Old Harbourmaster's, 8 North Street, Emsworth, Hampshire P010 7DD, England and from Atwell U.S. Pat. No. 4,269,927 issued May 26, 1981.

The following examples are intended to further illustrate this invention.

EXAMPLE 1

Single-color photographic print materials were prepared having the following structure:

Overcoat layer:

Gelatin (1.1 g/m$^2$), bis(vinylsulfonyl)methyl ether hardener (1.75% based on the total gelatin weight)

Blue sensitive silver halide emulsion layer:

Chemically and spectrally sensitized monodisperse silver chloride negative emulsion (0.34 g Ag/m$^2$) containing yellow-dye forming coupler: α-(4-(4-benzyloxyphenylsulfonyl)phenoxy)-α-(pivalyl)-2-chloro-5-(α-(2,4-di-t-amylphenoxy)butyramido)acetanilide (1.1 g/m$^2$) dispersed in di-n-butyl phthalate coupler solvent (0.27 g/m$^2$), gelatin (1.7 g/m$^2$)

Support:

A paper stock consisting of a mixture of hard and soft wood pulp extrusion overcoated with a titanium dioxide and zinc oxide pigmented polyethylene layer coated with 1.61 g/m$^2$ of gelatin.

The materials differed in pH as described in Table I below.

For the preparation of the material, three individual coating compositions were involved:

A. Composition for the overcoat layer

B. Composition for the silver halide emulsion

C. Composition for the yellow coupler dispersion

Before coating, the pH of each coating composition was determined and adjusted to the value indicated in Table I with dilute (1:6N) nitric acid.

The equilibrated surface pH of each element was measured using a Corning No. 476265 Combination Surface pH Electrode by pipetting 2 drops of 0.3M potassium nitrate on the coating surface, making electrode contact, and reading the pH after 3 min equilibration at room temperature.

Each element was divided into two parts. One was used as a control and held at −18° C. for two weeks, and the other was incubated at 49° C., 50% RH for two weeks.

Each element was solution processed at 35° C. in a three-step process of color development (45 sec), bleach-fix (45 sec), and wash or stabilization (90 sec) followed by drying (60 sec) at 60° C.

The formulations for the above solutions are:

(1) Color developer:

| | |
|---|---|
| Lithium salt of sulfonated polystyrene (30% by wt) | 0.25 mL |
| Triethanolamine | 11.0 mL |
| N,N-diethylhydroxylamine (85% by wt) | 6.0 mL |
| Potassium sulfite (45% by wt) | 0.5 mL |
| Color developing agent 4-(N-ethyl-N-2-methanesulfonylaminoethyl)-2-methyl-phenylenediaminesesquisulfate monohydrate | 5.0 g |
| Kodak Ektaprint 2 Stain-Reducing Agent (a stilbene material commercially available from Eastman Kodak Co.) | 2.3 g |
| Lithium sulfate | 2.7 g |
| Potassium chloride | 2.5 g |
| Potassium bromide | 0.025 g |
| Kodak Anti-Cal No. 5 (an organic phosphonic acid material commercially available from Eastman Kodak Co.) | 0.8 mL |
| Potassium carbonate | 25.0 g |
| Water to total of 1 liter, pH adjusted to 10.12 | |

(2) Bleach-fix:

| | |
|---|---|
| Ammonium thiosulfate | 58. g |
| Sodium sulfite | 8.7 g |
| Ethylenediaminetetraacetic acid ferric ammonium salt | 40. g |
| Acetic acid | 9.0 mL |
| Water to total 1 liter, pH adjusted to 6.2 | |

(3) Stabilizer:

| | |
|---|---|
| Sodium citrate | 1 g |
| Dearside (a biocide produced by Rohm and Haas) | 45 ppm |
| Water to total 1 liter, pH adjusted to 7.2 | |

After processing, the Status A blue density of each control and incubated coating was read and the change in D-min (no exposure density) was calculated. The data in Table I illustrate that coatings with an equilibrated surface pH value of 5.3 or below have improved raw stock keeping.

TABLE I

| Coating | Coating Composition pH A | B | C | Surface pH | Status A Blue Density Control | Δ |
|---|---|---|---|---|---|---|
| C-1 (control) | 6.0 | 5.9 | 5.3 | 5.7 | 0.07 | +0.23 |
| C-2 (control) | 6.0 | 5.9 | 5.3 | 5.7 | 0.07 | +0.25 |

TABLE I-continued

| Coating | Coating Composition pH A | B | C | Surface pH | Status A Blue Density Control | Δ |
|---|---|---|---|---|---|---|
| C-3 (control) | 6.0 | 5.9 | 5.3 | 5.7 | 0.07 | +0.21 |
| C-4 (comparison) | 6.0 | 5.0 | 5.3 | 5.6 | 0.07 | +0.25 |
| C-5 (comparison) | 6.0 | 5.0 | 5.0 | 5.5 | 0.07 | +0.23 |
| E-1 | 5.0 | 5.0 | 5.0 | 5.3 | 0.07 | +0.20 |
| E-2 | 4.5 | 5.0 | 5.0 | 5.1 | 0.07 | +0.16 |
| E-3 | 4.5 | 5.9 | 5.0 | 5.2 | 0.07 | +0.16 |
| E-4 | 4.5 | 5.9 | 5.3 | 5.3 | 0.07 | +0.18 |

EXAMPLE 2

This example is similar to Example 1 but provides data for multicolor elements where all individual emulsion, coupler, interlayer, and overcoat coating compositions were individually adjusted for pH. Details are shown in Table II below.

The following layers were coated in order on a commercial paper stock:

7. Overcoat layer:
   Gelatin (1.4 g/m$^2$)
6. UV absorbing layer:
   A mixture of hydroxyphenylbenzotriazoles (0.38 g/m$^2$), gelatin (0.66 g/m$^2$)
5. Red sensitive layer:
   Chemically and red spectrally sensitized monodisperse silver chloride negative emulsion (0.23 g Ag/m$^2$) and cyan-dye forming coupler C (0.45 g/m$^2$) in di-n-butyl phthalate coupler solvent (0.25 g/m$^2$), gelatin (1.1 g/m$^2$)
4. UV absorbing layer:
   A mixture of hydroxyphenylbenzotriazoles (0.38 g/m$^2$), gelatin (0.66 g/m$^2$)
3. Green sensitive layer:
   Chemically and green spectrally sensitized monodisperse silver chloride negative emulsion (0.29 g Ag/m$^2$) and magenta-dye forming coupler M (0.45 g/m$^2$) in di-n-butyl phthalate coupler solvent (0.22 g/m$^2$), gelatin (1.2 g/m$^2$)
2. Interlayer:
   Gelatin (0.76 g/m$^2$)
1. Blue Sensitive layer:
   Chemically and blue spectrally sensitized monodisperse silver chloride negative emulsion (0.34 g Ag/m$^2$) and yellow-dye forming coupler Y (1.1 g/m$^2$) in di-n-butyl phthalate coupler solvent (0.27 g/m$^2$), gelatin (1.5 g/m$^2$)

Support: A paper stock consisting of a mixture of hard and soft wood pulp extrusion overcoated with a titanium dioxide and zinc oxide pigmented polyethylene layer.

The layers 1 to 7 were hardened with bis(vinylsulfonyl)methyl ether at 12.8% of the total gelatin weight.

Coupler identifications are:

C=Cyan dye forming coupler: (2-(α-(2,4-di-tert-amylphenoxy)butyramido-4,6-dichloro-5-ethyl phenol M=Magenta dye forming coupler: 1-(2,4,6-trichlorophenyl)-3-(2-chloro-5-(α-(4-hydroxy-3-tert-butylphenoxy)-tetradecanoamido)anilino)-5-pyrazolone Y=Yellow dye forming coupler: α(4-(4-benzyloxyphenyl-sulfonyl)phenoxy)-α-(pivalyl)-2-chloro-5-(γ-(2,4-di-tamylphenoxy)butyramido)acetanilide Each coated layer had its own single coating composition except layers 5, 3, 1 which consisted of two separate compositions for each of the emulsion and coupler as in Example 1. Each of the ten compositions for coating was adjusted with (1:6N) nitric acid to the indicated pH.

The equilibrated surface pH of each finished coating was measured after 5 weeks keeping at room temperature as described in Example 1.

Each finished coating as a) used as a control and held at −18° C. for 6 months, or b) incubated at 26° C., 50% RH for 6 months.

Each element was solution processed at 35° C. in a three-step process of color development (45 sec), bleach-fix (45 sec), and stabilization (90 sec) followed by drying (60 sec) at 60° C. as described in Example 1.

After processing, the Status A blue, green and red densities of each control and incubated coating were read and the change in D-min (no exposure density) was calculated.

The data in Table II illustrate that coatings with an equilibrated surface pH of 5.3 or below have improved raw stock keeping.

TABLE II

| Coating | Coating Composition Adjusting to pH | Measured Surface pH | Status A Density Control R | G | B | Δ After Incubation R | G | B |
|---|---|---|---|---|---|---|---|---|
| C-10 (control) | 6.0* | 5.9 | 0.075 | 0.090 | 0.105 | +0.015 | +0.010 | +0.027 |
| E-10 | 5.0 | 5.3 | 0.089 | 0.081 | 0.109 | +0.004 | +0.013 | +0.015 |
| E-11 | 4.0 | 4.2 | 0.075 | 0.078 | 0.098 | +0.001 | +0.009 | +0.011 |

*The pH of the magenta coupler dispersion only was pH 5.3

EXAMPLE 3

This example is similar to Example 2 with regard to coating compositions and evaluation procedure except in place of the bis(vinylsulfonyl)methyl ether hardener, a more active hardener, 1-(4'-morpholinocarbonyl)-pyridinium-4-ethyl sulfonate, was used.

The data in Table III illustrate that coatings of lower surface pH have improved raw stock keeping. The coating with an equilibrated surface pH of 4.5 showed the greatest improvement. From a comparison between the data for the coating with an equilibrated surface pH of 5.6, and the data for the other two coatings, it is apparent that a value of 5.3 or below would provide good results.

TABLE III

| Coating | Coating Compositions Adjusting to pH | Surface pH | Status A Density Control R | G | B | Δ After Incubation R | G | B |
|---|---|---|---|---|---|---|---|---|
| C-20 (control) | 6.0* | 6.4 | 0.083 | 0.103 | 0.206 | +0.009 | +0.016 | +0.016 |
| C-21 (comparison) | 5.0 | 5.6 | 0.076 | 0.090 | 0.134 | +0.006 | +0.005 | +0.012 |
| E-20 | 4.0 | 4.5 | 0.075 | 0.086 | 0.099 | +0.001 | +0.004 | +0.008 |

*The pH of the magenta coupler dispersion only was pH 5.3

The invention has been described in detail, with reference to preferred embodiments thereof, but it will be understood that modifications can be effected within the spirit and scope of the invention.

What is claimed is:

1. A color photographic print material comprising a support, one or more gelatin silver halide emulsion layers having associated therewith one or more dye-forming couplers and optionally subbing layers, interlayers, and overcoat layers, wherein the silver halide emulsion side of the element has a surface pH of between 4.0 and 5.3.

2. A color photographic print material of claim 1 wherein the silver halide emulsion is a silver chloride or silver chlorobromide emulsion containing up to 20 mole percent bromide.

3. A color photographic print material of claim 2 wherein the emulsion is a silver chloride emulsion.

4. An element of claim 1 wherein the surface pH is between 4.7 and 5.1.

5. An element of claim 1 in which the gelatin layers have been hardened with an active hardener.

6. An element of claim 5 wherein the active hardener is a carbamoyl pyridinium compound or a bisformadinium compound.

* * * * *